US007861439B2

(12) United States Patent
Jager

(10) Patent No.: US 7,861,439 B2
(45) Date of Patent: Jan. 4, 2011

(54) METHOD AND DEVICE FOR RENEWING A BALLAST BED

(75) Inventor: Heinz Jager, Volketswil (CH)

(73) Assignee: J. Muller AG, Maschineller Geleiseunterhalt, Effretikon (CH)

( * ) Notice: Subject to any disclaimer, the term of this patent is extended or adjusted under 35 U.S.C. 154(b) by 0 days.

(21) Appl. No.: 12/438,671

(22) PCT Filed: Aug. 10, 2007

(86) PCT No.: PCT/CH2007/000392

§ 371 (c)(1),
(2), (4) Date: Feb. 24, 2009

(87) PCT Pub. No.: WO2008/022475

PCT Pub. Date: Feb. 28, 2008

(65) Prior Publication Data

US 2010/0006307 A1 Jan. 14, 2010

(30) Foreign Application Priority Data

Aug. 25, 2006 (CH) ..... 1360/06

(51) Int. Cl.
*E01B 27/00* (2006.01)

(52) U.S. Cl. ..... 37/104; 171/16

(58) Field of Classification Search ..... 37/104, 37/105; 171/16; 238/2–9, 129; 104/2, 7.1, 104/12

See application file for complete search history.

(56) References Cited

U.S. PATENT DOCUMENTS 3,872,939 A 3/1975 Teurer et al.
4,042,035 A * 8/1977 Boyer ..... 171/16
4,397,241 A * 8/1983 Newman ..... 104/2
5,513,452 A * 5/1996 Theurer et al. ..... 37/104
RE35,788 E * 5/1998 Theurer et al. ..... 37/104
6,427,925 B1 * 8/2002 Gaudet ..... 238/8

FOREIGN PATENT DOCUMENTS

| | | | |
|---|---|---|---|
| DE | 1 207 415 | B | 12/1965 |
| DE | 27 33 084 | A1 | 3/1978 |
| DE | 43 43 148 | A1 | 10/1994 |
| DE | 101 18 393 | A1 | 12/2002 |
| EP | 1 191 147 | A1 | 3/2002 |
| GB | 2 127 377 | A | 4/1984 |

* cited by examiner

*Primary Examiner*—Robert E Pezzuto
(74) *Attorney, Agent, or Firm*—Sughrue Mion, PLLC

(57) ABSTRACT

In a method for the continuous renewal of a ballast bed (41) of a track from which the rails and sleepers have been removed, by carrying away old ballast (42) and depositing cleaned ballast or new ballast (44) on the underlying surface (46) from which the old ballast (42) has been removed, a removal device (22) which can travel in the working direction (x) continuously picks up the old ballast (42) of the ballast bed (41). The excavated material is conveyed away from the excavation area and possibly passed on for ballast cleaning At the same time, cleaned ballast or new ballast (44) is continuously deposited in the working direction (x) on the underlying surface (46) from which the old ballast (42) has been removed, to form a new ballast bed (43). The removal device (22), as part of an excavating machine (10) traveling in the working direction (x) on the old ballast bed (41), is arranged downstream of the running gear (14, 16) of the excavating machine (10).

14 Claims, 3 Drawing Sheets

METHOD AND DEVICE FOR RENEWING A BALLAST BED

TECHNICAL FIELD OF THE INVENTION

The invention relates to a method for the continuous renewal of a ballast bed of a track from which the rails and sleepers have been removed, by carrying away old ballast and depositing cleaned ballast or new ballast on the substrate from which the old ballast has been removed, in which method a removal device which can travel in the working direction continuously picks up the old ballast of the ballast bed, the excavated material is conveyed away from the excavation region and possibly passed on for ballast cleaning and at the same time cleaned ballast or new ballast is continuously deposited in the working direction on the substrate from which the old ballast has been removed, to form a new ballast bed. The scope of the invention also includes an arrangement of appliances for carrying out the method and a transport carriage.

PRIOR ART

A method for the cleaning of ballast of a track is known from EP-A-1 191 147. A ballast cleaning machine which is used for this purpose is moved over the section of track to be cleaned for the purposes of cleaning the ballast. Using an endless, rotating clearing chain, which is fed through transversely to the longitudinal direction of the machine below the locally raised track, the ballast located below the track is continuously carried away and passed on to a screening installation. The cleaned ballast issuing from the screening installation is subsequently discarded back onto the track.

If a track renewal or relaying of the existing tracks is carried out at the same time as the ballast cleaning, the ballast bed is renewed in a portion in which the track has in each case been removed beforehand. As the ballast cleaning advances, in each case on the one hand a new or the previously dismantled piece of track is laid out on the renewed ballast bed and on the other hand a piece of track is removed on a ballast bed which has not yet been renewed.

In the case of a known method of the type mentioned at the outset, the old ballast of the ballast bed to be renewed is continuously carried away by a bucket conveyor which is arranged upstream of a ballast cleaning machine through the machine moving forward in the working direction, cleaned in a screening installation on the machine and subsequently, immediately after the bucket conveyor, brought out again as cleaned ballast on the substrate from which the old ballast has been removed. The excavated earth is conveyed, for the purposes of disposal, counter to the working direction into a transport carriage positioned after the machine.

The method described hereinbefore has the drawback that the relaying of a track which was previously removed from the old ballast bed on the renewed ballast bed cannot be carried out directly at the same location and the track portions must for this reason in each case be placed in a relatively short time and at great expense after the machine, wherein the relaying of the tracks can be carried out only when the excavation has been completed and the ballast cleaning machine has left the excavation region. A further drawback is the high weight of the known excavation and cleaning machine.

ACCOUNT OF THE INVENTION

The invention is based on the object of providing a method of the type mentioned at the outset and also an arrangement which is suitable for carrying out the method, allowing the drawbacks from which the methods and devices according to the prior art suffer to be avoided. A further aim of the invention is the provision of a method and an arrangement which are suitable both for normal ballast cleaning and for substrate redevelopment with total excavation.

With regard to the method, the object is achieved, in accordance with the invention, in that the removal device, as part of an excavating machine traveling in the working direction on the old ballast bed, is arranged downstream of the running gear of the excavating machine.

In the case of a preferred implementation of the method according to the invention, the old ballast, which is carried away by the removal device from the ballast bed, is conveyed as excavated material in the working direction into a first transport carriage, which is provided before the excavating machine and can travel on the old ballast bed, and the cleaned ballast or the new ballast is conveyed from the first transport carriage counter to the working direction after the removal device and deposited onto the substrate from which the old ballast has been removed.

For ballast cleaning without total excavation, the first transport carriage expediently comprises a ballast cleaning unit and the old ballast, which is conveyed from the removal device, is cleaned in the ballast cleaning unit and the cleaned ballast is conveyed back after the removal device and deposited on the substrate from which the old ballast has been removed.

For substrate redevelopment with total excavation, the first transport carriage preferably contains new ballast and sand separately from each other and new ballast and sand are conveyed from the first transport carriage separately after the removal device and deposited as separate layers on the substrate from which the old ballast has been removed and which is covered by an underlay made of geotextile or geogrid.

In the case of a first preferred manner of carrying out the method according to the invention, the first transport carriage oscillates, for loading and/or unloading, between the excavating machine and a second transport carriage which is positioned on a track ending at the ballast bed to be removed and provided for the supply and removal of materials. In the case of this procedure, the excavating machine is stationary during the oscillating travel of the first transport carriage, i.e. its excavating performance is zero during this time.

In the case of a second preferred manner of carrying out the method according to the invention, the first transport carriage remains stationary in the excavating machine and a third transport carriage oscillates, for loading and/or unloading, between the first transport carriage and a second transport carriage which is positioned on a track ending at the ballast bed to be removed and provided for the supply and removal of materials. In the case of this shuttle mode of a third transport carriage, the excavating machine can be used for continuous conveyance at maximum power.

An arrangement which is suitable for carrying out the method according to the invention comprises an excavating machine which can travel on the old ballast bed in the working direction and has a removal device which is arranged following the running gear of the excavating machine, at least one transport carriage for loading and/or unloading with/of materials which are produced/required during renewal of a ballast bed, optionally a ballast and sand distributing machine, and also conveying means for transporting the materials which are produced/required during renewal of a ballast bed.

The removal device of the excavating machine and a ballast silo provided for the depositing of ballast are preferably arranged on a swivel arm which can swivel about a vertical axis of rotation and a horizontal pitch axis.

The removal device is preferably a feed screw. A feed screw is less noisy than other excavation systems, has a compact design, is effective and displays good efficiency. A further preferred removal device is an impeller wheel.

For ballast cleaning without total excavation, one of the transport carriages preferably comprises a ballast cleaning unit.

For substrate redevelopment with total excavation, the transport carriages preferably have a first loading plane for the interim storage of excavated material and a second loading plane arranged above the first loading plane for the interim storage of ballast and/or sand and the second loading plane for the supply of ballast and/or sand can be lowered for the purposes of lowering the center of gravity of the transport carriage and can be raised above the first loading plane for increasing the size of the loading volume which is provided for the interim storage of excavated material.

The loading surfaces of the transport carriages are preferably embodied as conveyor belts.

The ballast and sand distributing machine preferably comprises a swivel arm which can swivel about a vertical axis of rotation and a horizontal pitch axis and two silos, which are provided for the depositing of sand and ballast, are arranged on the swivel arm. At their lower end, the silos are preferably equipped with a compressor.

The machines and vehicles which are provided for traveling on the ballast bed and on tracks, in particular the excavating machine, the ballast and sand distributing machine and the transport carriages, are expediently equipped with an alternately usable tracked running gear and a rail running gear.

BRIEF DESCRIPTION OF THE DRAWINGS

Further advantages, features and details of the invention will emerge from the subsequent description of preferred exemplary embodiments and also with reference to the drawings, in which.

DESCRIPTION OF EXEMPLARY EMBODIMENTS

Figure 1:
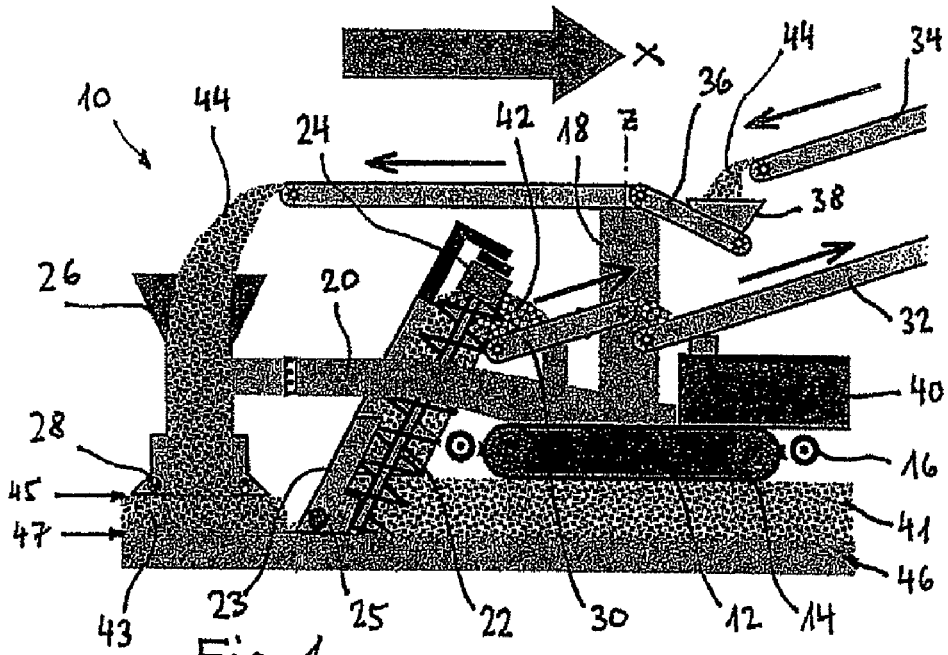
FIG. 1 is a schematic side view of an excavating machine.

An excavating machine 10 illustrated in FIG. 1 has a movable base 12 with a tracked running gear 14 for advancing on a ballast bed and a rail running gear 16 for advancing on tracks. A swivel tower 18 having a vertical swivel axis z protrudes from the movable base 12 perpendicularly to a notional bearing plane of the running gears 14, 16. A swivel arm 20 is mounted on the swivel tower 18 so as to be able to rotate about the swivel axis z.

A feed screw 22, which is inclined in the working direction x and encloses an acute angle with the notional bearing plane of the running gears 14, 16, is secured to the swivel arm 20. On its back, the feed screw 22 is surrounded by a dozer blade 23 with a compressor 25. The lower edge of the dozer blade 23 rests on the excavated track formation. A ballast silo 26, with a compressor 28 arranged at the bottom-side end thereof, is located at the free end of the swivel arm 20.

The excavating machine 10 is equipped with conveyor belts 30, 32, 36, the function of which will be examined in greater detail hereinafter. A drive and energy unit 40 serves inter alia to advance the excavating machine, to carry out swiveling movements of the swivel arm 20 about the swivel axes z, y and to drive 24 the feed screw 22.

The tracked running gear 14 of the excavating machine 10 rests on a ballast bed 41 made of old ballast 42. During the traveling of the excavating machine 10 in the working direction x, the old ballast 42 is continuously conveyed by the feed screw 22 onto the conveyor belt 30, which is secured to the swivel arm 20, and therefrom further onto the conveyor belt 32, which is fixedly mounted on the movable base. To the same degree as the carrying-away of old ballast 42 via the feed screw 22 and the two conveyor belts 30, 32, cleaned ballast or new ballast 44 is passed on via the conveyor belt 34 into a silo 38 arranged on the conveyor belt 36. From the conveyor belt 36, the cleaned ballast or new ballast 44 falls into the ballast silo 26 and is continuously deposited on the excavated track formation 47 of the earth foundation 46 and compressed via the compressor 28 onto the desired ballast track formation 45 of the ballast bed 43.

Figure 2:
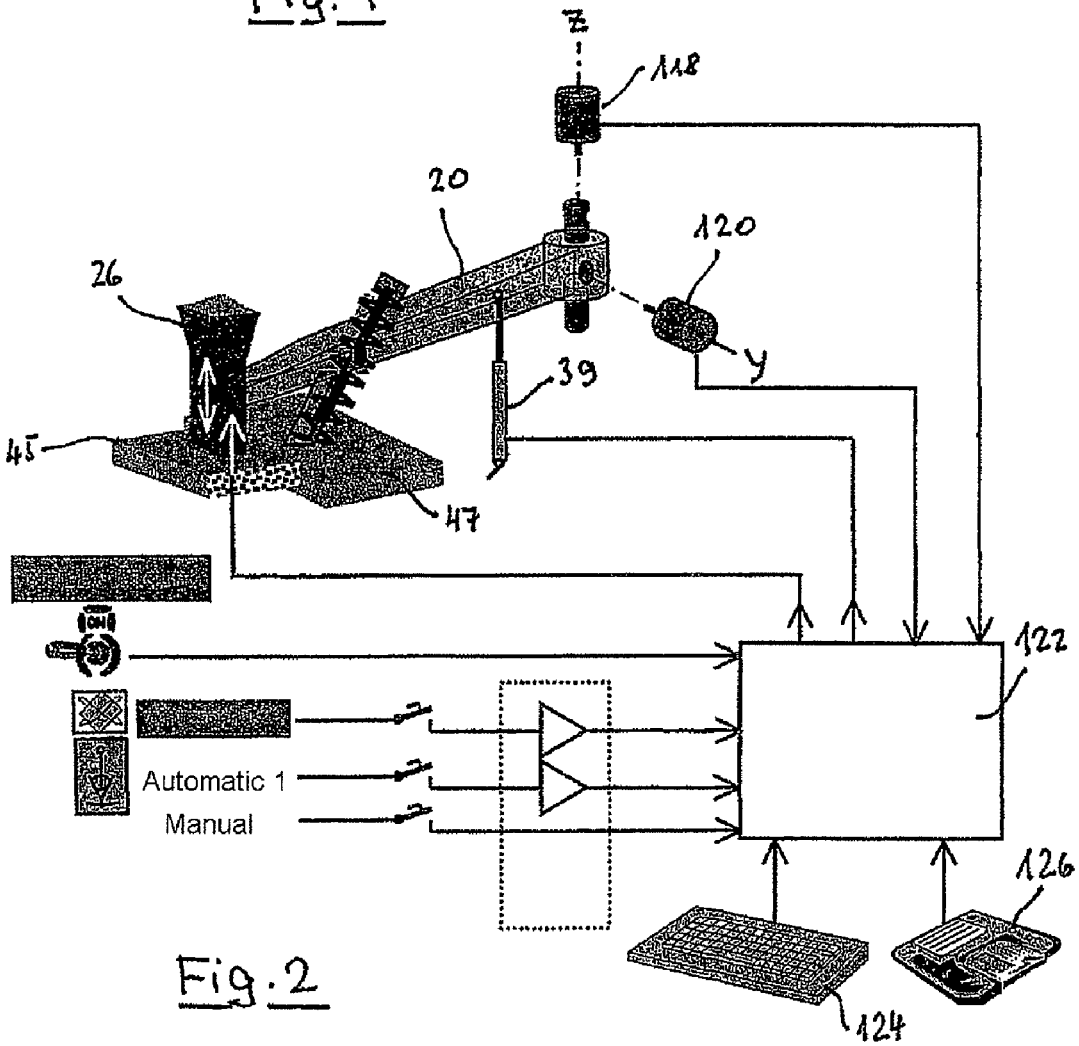
FIG. 2 shows schematically a measurement and control scheme for the excavating machine of FIG. 1.

The measurement and control scheme shown in FIG. 2 for the excavating machine 10 illustrated in FIG. 1 reveals the swiveling movements which are carried out by the swivel arm 20 and thus by the feed screw 22 and by the ballast silo 26. A swiveling movement of the swivel arm 20 about the vertical swivel axis z leads to a horizontal swiveling movement of the feed screw 22 and of the ballast silo 26 over the entire width of the ballast bed 41, 43 to be carried away or to be newly constructed. The height of the lower edge of the feed screw 22 and the height of the lower edge of the ballast silo 26 with respect to a reference value are set by a corresponding swiveling movement of the swivel arm 20 about a horizontal pitch axis y, which is arranged at right angles to the swivel axis z, by means of a lifting cylinder 39.

The excavation depth and excavation width are each measured using an angle gauge 118 for the angle of rotation of the vertical swivel axis z and an angle gauge 120 for the angle of rotation of the horizontal pitch axis y and passed on to a computer unit 122. Based on the inputs via a keyboard 124, the computer unit 122 defines the vertical and transverse positions for the excavated track formation 47 and the ballast track formation 45. Construction site data, such as for example the construction site geometry, the excavated depth, the excavated transverse position, the ballast track formation height and the ballast track formation transverse position, can be collected off-line, i.e. before work commences, and stored on a floppy disk 126.

The measurement and control scheme is designed for at least three different levels of automation, so that in the event of problems with the electronics it is possible to switch back to the respectively simpler level. In the event of a computer failure, work can nevertheless be continued using a manual or emergency controller by direct activation of the hydraulic valves. The following control commands can be sent to the excavating machine via a remote controller: advancement, excavation width, material flow, various interventions into the automatic controller such as for example stop, start, etc.

Figure 3:
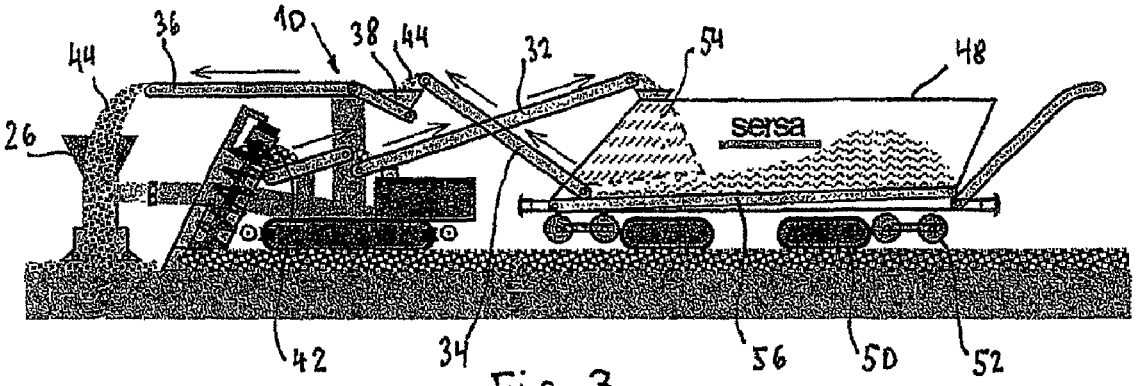
FIG. 3 is a schematic side view of a ballast cleaning arrangement with the excavating machine of FIG. 1 and a transport carriage.

As shown in FIG. 3, the excavated earth of the old ballast 42 is removed by the excavating machine 10 via the conveyor belt 32 to a first transport carriage 48 from which cleaned ballast 44 is passed on to the silo 38 via the conveyor belt 34 and to the ballast silo 26 via the conveyor belt 36.

The first transport carriage 48 is equipped both with a tracked running gear 50 and with a rail running gear 52. The excavated earth of the old ballast 42 is passed on via a cleaning unit 54 which is arranged in the carriage interior, in the region of one of the carriage ends, and from which the cleaned ballast 44 is returned via the conveyor belt 34. The residual material, consisting of undersize particles and oversize particles, remains as excavated earth 49 in the first transport carriage 48, which serves as an interim storage means, and is conveyed away from the cleaning unit 54 toward the more remote carriage end via a conveyor belt 56 spanning the bottom of the carriage.

Figure 4:
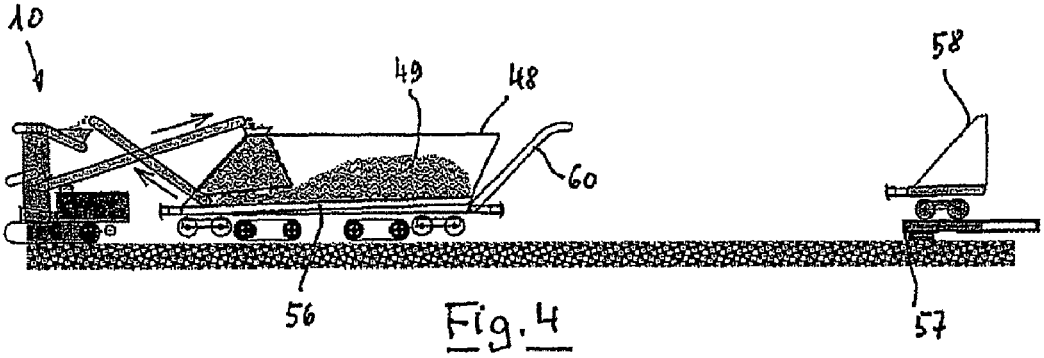
FIG. 4-6 show schematically a shuttle mode of the arrangement of FIG. 3.
Figure 5:
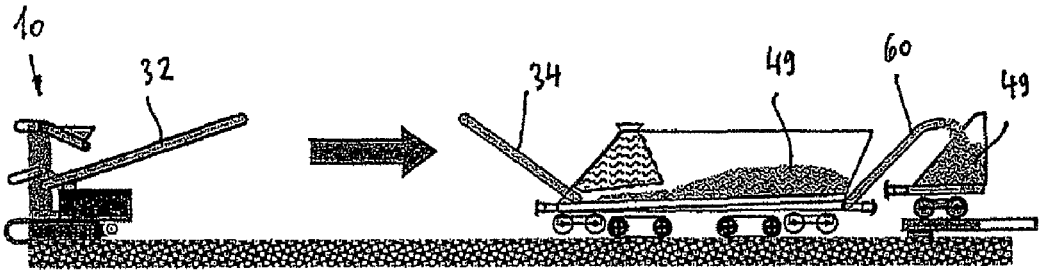

As soon as the first transport carriage 48 is filled with excavated earth 49 (FIG. 4), the excavation is interrupted and the first transport carriage 48 returns, on the ballast bed 41 made of old ballast 42, up to a second transport carriage 58 which is deposited at a free track end 57. The excavated earth 49 is transferred from the first transport carriage 48 into the second transport carriage 58, which is ready for use, via the conveyor belt 56, which spans the bottom of the carriage, and a further conveyor belt 60 which is adjoined to said conveyor belt 56 (FIG. 5). The emptied first transport carriage 48 subsequently returns back to the excavating machine 10.

Figure 6:
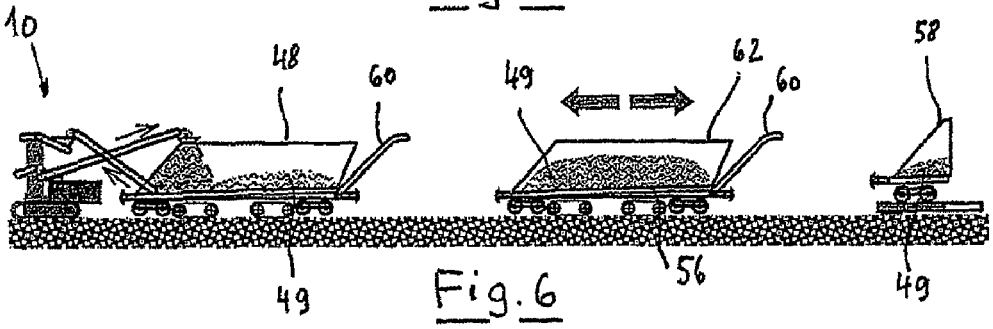

In the case of the variant shown in FIG. 6 of the removal of excavated earth 49 from first transport carriages 48, a third transport carriage 62, which corresponds to a first transport carriage 48 without a cleaning unit 54 but with a conveyor belt bottom 56, is used as a shuttle between the first transport carriage 48, which remains in the excavating machine 10, and the second transport carriage 58. In this shuffle mode, the excavating machine 10 can continuously convey at maximum power.

Figure 7:
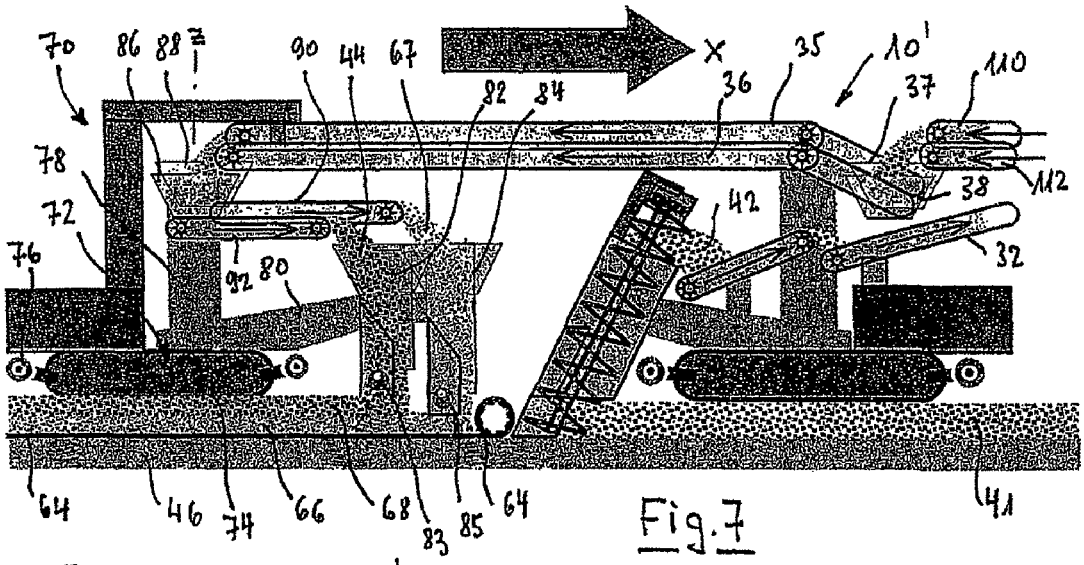
FIG. 7 is a schematic side view of the excavating machine of FIG. 1 in combination with a ballast and sand distributing machine.

The arrangement shown in FIG. 7 is used when the ballast bed 41 made of old ballast 42 has to be removed within a total excavation and a new ballast bed having an underlay 64 made of geotextile or a geogrid, a first layer 66 made of sand 67 and a second layer 68 made of new ballast 44 has to be constructed.

An excavating machine 10' used for this purpose is substantially identical in its basic construction to the excavating machine 10 shown in FIG. 1, but does not have a ballast silo 26. Furthermore, a second conveyor belt 35, with a silo 37 which is arranged upstream for the transportation of sand 67, is arranged parallel to the conveyor belt 36, with a silo 38 which is arranged upstream for the transportation of new ballast 44.

A stand and ballast distributing machine 70, which is substantially identical in its basic construction to the excavating machine 10', is arranged downstream of the excavating machine 10' in the working direction x.

The sand and ballast distributing machine 70 has a movable base 72 with a tracked running gear 74 and a rail running gear 76. A swivel tower 78 having a vertical swivel axis z protrudes from the movable base 72 perpendicularly to a notional bearing plane of the running gears 74, 76. A swivel arm 80 is mounted on the swivel tower 78 so as to be able to rotate about the vertical swivel axis z.

A ballast silo 82 and a sand silo 84 are arranged one after the other and offset from each other on the swivel arm 80, the sand silo 84 being further removed from the swivel tower 78 than is the ballast silo 82. Two silos 86, 88, each having conveyor belts 90, 92 leading from the silos 86, 88 via the sand silo 84 or the ballast silo 82, are also secured to the swivel tower 78. In the region of their bottom-side ends, the sand silo 84 and the ballast silo 82 are equipped with compressors 85 and 83 respectively.

The sand and ballast distributing machine 70 rests with its tracked running gear 74 on a newly constructed ballast bed consisting of an underlay made of geotextile or geogrid 64, a first layer 66 made of sand 67 and a second layer 68 made of new ballast 44.

Figure 8:
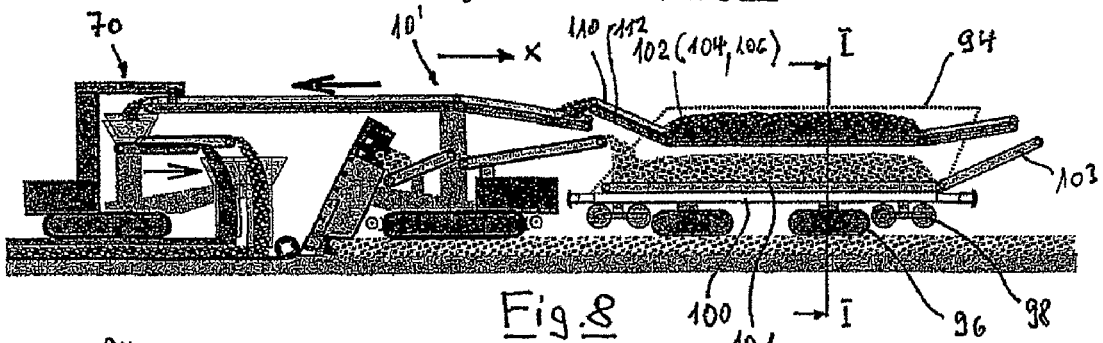
FIG. 8 is a schematic side view onto the arrangement of FIG. 7 in combination with a transport carriage.
Figure 9:
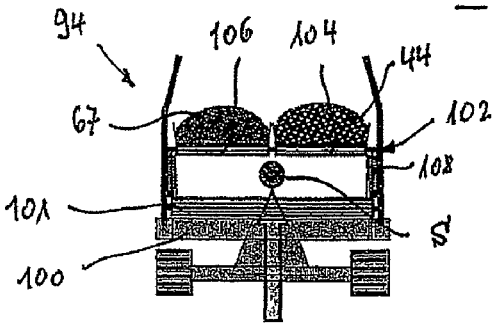
FIG. 9 is a schematic section through the transport carriage of FIG. 8 along the line I/I thereof in transport mode.
Figure 10:
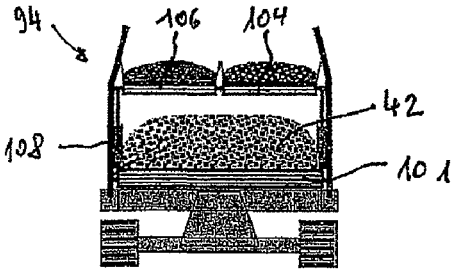
FIG. 10 shows schematically the section of FIG. 9 through the transport carriage in working mode.

As may be seen from FIG. 8, a first transport carriage 94 for passing on sand and ballast is mounted upstream of the excavating machine 10' in the working direction x. The first transport carriage 94 for passing on sand and ballast is equipped both with a tracked running gear 96 and with a rail running gear 98. The first transport carriage 94 has a carriage bottom 100 with a first conveyor belt 101 spanning said carriage bottom for the interim storage of excavated material made of old ballast 42 and an intermediate bottom 102 which is arranged above the carriage bottom 100 and is in the form of two conveyor belts 104, 106, which are guided in the carriage longitudinal direction parallel next to each other, for the interim storage of sand 67 and new ballast 44. The height of the intermediate bottom 102 can be adjusted via hydraulic cylinders 108. During the transfer on the rail from a ballast and sand loading site to a work site, the intermediate bottom 102 is lowered in order to keep the center of gravity S as low as possible (FIG. 9). In working mode, the intermediate bottom 102 is raised to provide an interim storage space which is as large as possible for the excavated material (FIG. 10). The excavated earth of the old ballast 42 is passed on by the excavating machine 10' via the conveyor belt 32 onto the carriage bottom 100 or onto the conveyor belt 101 resting on the carriage bottom 100. Sand 67 and new ballast are passed on from the intermediate bottom 102 of the first transport carriage 94 to the sand and ballast distributing machine 70 via further conveyor belts 110, 112 into the silos 37, 38 which are mounted upstream of the conveyor belts 35, 36.

The sand and ballast distributing machine 70, the excavating machine 10' and the first transport carriage 94 for passing on sand and ballast are moved during the working operation in synchronization and at the same speed in the working direction x.

As soon as the first transport carriage 94 has been emptied of sand 67 and new ballast 44 and at the same time loaded with old ballast 42, the excavation is interrupted and the carriage 94 returns, on the ballast bed 41 made of old ballast 42, up to a second transport carriage 114, which is deposited at a free track end 57, for passing on sand and ballast. The excavated earth made of old ballast 42 is transferred from the first transport carriage 94 into the second transport carriage 114, which is ready for use, via the conveyor belt 101 forming the carriage bottom 100 and a further conveyor belt 103 which is adjoined to said conveyor belt 101. At the same time, sand 67 and new ballast 44 are transferred from the second transport carriage 114 into the first transport carriage 94. The first transport carriage 94 subsequently returns, freshly loaded with sand 67 and new ballast 44, back to the excavating machine 10'.

Figure 11:
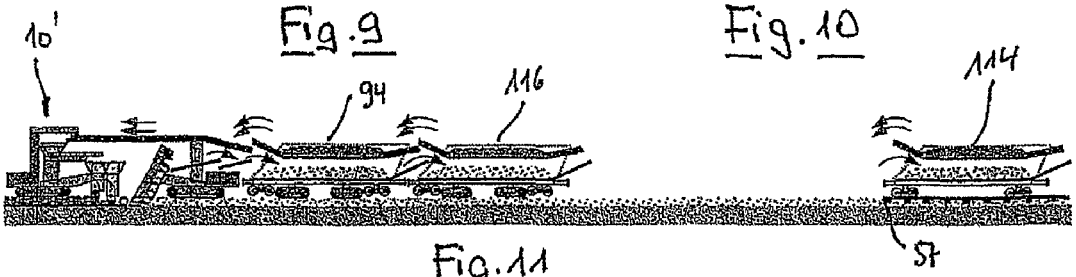
FIG. 11 shows schematically a shuttle mode with the arrangement of FIG. 8.

In the case of the variant shown in FIG. 11 of the removal of excavated earth into, and the passing-on of sand and new ballast from, the first transport carriage 94 for the passing-on of sand and ballast, a third transport carriage 116 is used as a shuttle between the first transport carriage 94, which now remains in the excavating machine 10', and the second transport carriage 114. In this shuttle mode, the excavating machine 10' can convey continuously at maximum power.

LIST OF REFERENCE NUMERALS

10 Excavating machine
12 Movable base
14 Tracked running gear
16 Rail running gear
18 Swivel tower
20 Swivel arm
22 Feed screw
23 Dozer blade
24 Drive of 22
25 Compressor
26 Ballast silo
28 Compressor
30 Conveyor belt
32 Conveyor belt
34 Conveyor belt
36 Conveyor belt
37 Silo on 35
38 Silo on 36
39 Lifting cylinder on 20
40 Drive and energy unit
41 Ballast bed made of old ballast
42 Old ballast
43 Ballast bed made of cleaned ballast or new ballast
44 Cleaned ballast or new ballast
45 Ballast track formation
46 Earth foundation
47 Excavated track formation
48 First transport carriage
49 Excavated earth
50 Tracked running gear
52 Rail running gear
54 Cleaning unit
56 Conveyor belt as bottom of 48
57 Free track end
58 Second transport carriage
60 Conveyor belt on 48
62 Third transport carriage
64 Underlay made of geotextile or geogrid
66 Layer made of sand
67 Sand
68 Layer made of new ballast 44
70 Ballast and sand distributing machine
72 Movable base
74 Tracked running gear
76 Rail running gear
78 Swivel tower
80 Swivel arm
82 Ballast silo
84 Sand silo
86 Silo
88 Silo
90 Conveyor belt
92 Conveyor belt
94 First transport carriage
96 Tracked running gear
98 Rail running gear
100 Carriage bottom
101 Conveyor belt
102 Intermediate bottom
103 Conveyor belt
104 Conveyor belt
106 Conveyor belt
108 Hydraulic cylinder
110 Conveyor belt
112 Conveyor belt
114 Second transport carriage
116 Third transport carriage
118 Angle gauge for the angle of rotation of z
120 Angle gauge for the angle of rotation of y
122 Computer unit
124 Keyboard
126 Floppy disk
x Working direction
S Center of gravity
y Pitch axis
z Vertical axis

The invention claimed is:

1. A method for the continuous renewal of a ballast bed of an excavation region comprising a substrate on which old ballast forming an old ballast bed is disposed and a track from which rails and sleepers have been removed, using (1) an excavating machine that comprises a removal device, a first conveying device operationally coupled to the removal device, a second conveying device and running gear, and (2) a plurality of transport carriages, said method comprising:

moving the excavating machine so that the removal device travels in a working direction (x), continuously excavating material, by said removal device picking up at least the old ballast of the old ballast bed, conveying away the material that is excavated from the excavation region, possibly for ballast cleaning, and at the same time, continuously depositing, using said second conveying device, one of a cleaned and a new ballast in the working direction (x) on the substrate from which the old ballast has been removed, to form a new ballast bed, wherein the removal device, as part of an excavating machine traveling in the working direction (x) on the old ballast bed, is arranged downstream of the running gear of the excavating machine, wherein the old ballast, which is excavated by the removal device from the old ballast bed, is conveyed by said first conveying device as excavated material in the working direction (x) into a first transport carriage, which is provided upstream of the excavating machine and can travel on the old ballast bed, wherein at least one of cleaned ballast or new ballast is conveyed from the first transport carriage counter to the working direction (x) to a location downstream of the removal device and is deposited onto the substrate from which the old ballast has been removed, and wherein at least one of said plurality of transport carriages is a rail running carriage positioned on a rails ending at the old ballast bed to be removed and is provided for the supply and removal of materials and at least another of said plurality of transport carriages is a shuttle carriage that shuttles between said excavating machine or another transport carriage and said rail running carriage.

2. The method as claimed in claim 1, further characterized in that the first transport carriage comprises a ballast cleaning unit and the old ballast, wherein the method further comprises:

covering the substrate downstream of the removal device with an underlay made of geotextile or geogrid;

cleaning the old ballast which is conveyed from the removal device to the first transport carriage in the ballast cleaning unit to form cleaned ballast, and conveying the cleaned ballast to a location on the substrate that is downstream of the removal device and depositing the cleaned ballast onto the substrate from which the old ballast has been removed and which is covered by the underlay made of geotextile or geogrid.

3. The method as claimed in claim 1, further characterized in that the first transport carriage contains new ballast and sand separately from each other, wherein the method further comprises:

conveying new ballast and sand from the first transport carriage separately to a location on the substrate that is downstream of the removal device, and depositing said new ballast and said sand as separate layers onto the substrate from which the old ballast has been removed.

4. The method as claimed in claim 1, characterized in that the first transport carriage is a shuttle carriage that shuttles, for at least one of loading and unloading, between the excavating machine and a second transport carriage which is positioned on rails ending at the ballast bed to be removed and provided for the supply and removal of materials.

5. The method as claimed in claim 1, characterized in that the first transport carriage remains stationary in the excavating machine and a third transport carriage is a shuttle carriage that shuttles, for at least one of loading and unloading, between the first transport carriage and a second transport carriage which is positioned on rails ending at the ballast bed to be removed and provided for the supply and removal of materials.

6. An arrangement for continuous renewal of a ballast bed of an excavation region comprising a substrate on which old ballast forming an old ballast bed is disposed and a track from which rails and sleepers have been removed, comprising:

an excavating machine having a removal device, a conveying means comprising a first conveying device operationally coupled to the removal device and a second conveying device, and running gear which can travel on the old ballast bed in a working direction (x), said removal device being arranged downstream of the running gear of the excavating machine, at least one transport carriage for at least one of loading and unloading of materials which are produced/required during renewal of a ballast bed, optionally a ballast and sand distributing machine, and said conveying means being operative for transporting the materials which are produced/required during renewal of a ballast bed, wherein a first transport carriage has a first loading plane for the interim storage of excavated material and a second loading plane arranged above the first loading plane for the interim storage of at least one of new ballast and sand and the second loading plane for the supply of at least one of new ballast and sand can be lowered for the purposes of lowering the center of gravity (S) of the first transport carriage and can be raised above the first loading plane for increasing the size of the loading volume which is provided for the interim storage of excavated material, and wherein at least one of the excavating machine, the ballast and sand distributing machine and the transport carriages, is equipped with an alternately usable tracked running gear and a rail running gear.

7. The arrangement as claimed in claim 6, characterized in that the excavating machine further comprises a swivel arm, and wherein the removal device and a ballast silo provided for the depositing of ballast are arranged on the swivel arm which can swivel about a vertical axis of rotation (z) and a horizontal pitch axis (y).

8. The arrangement as claimed in claim 6, characterized in that the removal device is a feed screw or an impeller wheel.

9. The arrangement as claimed in claim 6, characterized in that one of the transport carriages comprises a ballast cleaning unit.

10. The arrangement as claimed in claim 6, characterized in that the loading surfaces of the transport carriages are embodied as conveyor belts.

11. The arrangement as claimed in claim 6 characterized in that the ballast and sand distributing machine comprises a swivel arm which can swivel about a vertical axis of rotation (z) and a horizontal pitch axis (y) and two silos, which are provided for depositing of sand and new ballast and are arranged on the swivel arm.

12. The arrangement as claimed in claim 11, characterized in that the silos are equipped at their lower end with a compressor.

13. The transport carriage as claimed in claim 6, characterized in that the loading planes are embodied as conveyor belts.

14. The transport carriage as claimed in claim 6, characterized in that the transport carriage is equipped, for traveling on the ballast bed and on tracks, with an alternately usable tracked running gear and a rail running gear.

* * * * *